United States Patent [19]

Olson et al.

[11] Patent Number: 4,486,736

[45] Date of Patent: Dec. 4, 1984

[54] THERMAL ACTUATED CUT-OFF LINK

[75] Inventors: Harry Olson, Woodridge; John M. Borzoni, Des Plaines, both of Ill.

[73] Assignee: Littelfuse, Inc., Des Plaines, Ill.

[21] Appl. No.: 444,371

[22] Filed: Nov. 26, 1982

[51] Int. Cl.[3] ..... H01H 37/76

[52] U.S. Cl. ..... 337/409; 337/407

[58] Field of Search ..... 337/409, 408, 407; 29/623

[56] References Cited

U.S. PATENT DOCUMENTS

| | | | |
|---|---|---|---|
| 4,246,564 | 1/1981 | Olson et al. | 337/409 |
| 4,281,309 | 7/1981 | Olson | 337/409 |
| 4,326,186 | 4/1982 | Clay | 337/409 |

*Primary Examiner*—Harold Broome

*Attorney, Agent, or Firm*—Russell E. Hattis

[57] ABSTRACT

Apparatus and methods for assembling a thermally-actuated cut-off link having a casing, a closure, split along its length to form a slot, a power lead, one end of which extends from the casing through a neutral passage formed in the closure, the other end of which terminates in a pair of outwardly deformed, inwardly deformable contact arms forced into low-resistance contact with an inner conductive surface of the casing, a fusible pellet, and a spring-biased arm-deforming member which, responsive to deform the contact arms away from the inner conductive surface to interrupt the flow of current through the cut-off link. The closure is secured to the casing by crimping the casing to grippingly contact the power lead and to narrow the slot. Relatively viscous sealant, placed in an enlarged section of the closure passage is drawn into the narrowed slot by capillary action, and is thereafter cured. The power lead is roughened, as by knurling, over that portion of the power lead at which the closure grips the power lead. The arm-deforming member is shaped and dimensioned to define an air space about the contact arms at those points at which the contact arms contact the casing, to minimize the effects of arcing caused by high voltages.

9 Claims, 14 Drawing Figures

THERMAL ACTUATED CUT-OFF LINK

BACKGROUND OF THE INVENTION

This invention relates to improvements in thermally actuated cut-off links, commonly referred to as thermal fuses or cut-offs, which are commonly normally closed switches of a type which respond to the ambient temperature. Typically, when the ambient temperature reaches a certain value, the cut-off link opens, interrupting the flow of electrical current therethrough. Normally closed versions of thermally actuated cut-off links, for example, are frequently physically incorporated into the windings of electric motors and to other devices requiring thermal protection and electrically connected in series with such devices so that the cut-off link will deenergize the device involved when the ambient temperature exceeds a given safety value.

Ambient thermally actuated cut-off links of the type herein considered are the subject of U.S. Pat. No. 4,246,564, issued to Olson and Borzoni, U.S. Pat. No. 4,281,309, issued to Olson, and U.S. Pat. No. 4,326,186, issued to Clay, all of which are assigned to the assignor hereof.

While the specific detailed descriptions of the above-mentioned U.S. Patents are herein incorporated by reference, an abbreviated description of the elements thereof is herewith presented to make possible a better understanding of the present invention.

Both such patents disclose cut-off links comprising a cylindrical metal casing having a first power lead passing into and insulated from the casing, the power lead terminating in a pair of integral, laterally outwardly inclining, deformable, contact-forming arms pressed against a backing member which expands the same against the inner surface of the casing. A second power lead is permanently connected, as by swaging, to the casing so that there is only one contact interface between the power leads, namely that between the arms and the casing. This contact interface is broken when the arms are bent inward by a contact arm-deforming member which is forced by spring pressure against the arms when the ambient temperature to which the link is subjected reaches a control temperature for which the link is designed. Additionally, the first power lead and contact-forming arms are preferably made of a relatively soft, very low resistance material, like silver coated copper, which, when pressed against the curved inner face of the casing, deforms somewhat to increase the contact area to minimize contact resistance.

The casing contains also a pellet of fusible material, preferably located at the initially closed end of the casing, a pair of opposed compressed spring means on opposite sides of the arm-deforming and backing members and a closure member at the initially open end of the casing. The springs are held in a compressed state by the crimping of the casing around the closure member while the springs are held compressed by external pressure applied to the closure member. Upon the melting of the pellet, the arm-deforming member is forced by one of the springs against the contact-forming arms to collapse the arms and separate them from the casing walls. Before the pellet melts, the force of the springs is not applied against the first power lead and associated contact-forming arms. Rather, these arms are held in an expanded state against said backing member by the closure member of the casing engaging the first power lead.

After the various elements described have been inserted within the initially open end of the casing and prior to closing the open end thereof with the closure member, the first power lead and associated contact-forming arms are externally pressed inwardly toward the backing member with a progressively increasing force which spreads and forces the contact-forming arms progressively more firmly against the casing walls, until a measured contact resistance between the power leads drops to a predetermined desired value (like 0.9 milliohms when measured at 1.5" between probe points on the power leads). This adjusted force will generally provide a lower contact resistance with the casing wall than is readily achievable by the force of the contact-forming arms unaided by other forces. When the contact resistance reaches this value, the power lead is anchored in its adjusted position by anchoring the closure member until it engages the first power lead.

As disclosed in U.S. Pat. No. 4,246,564, the closure is a longitudinally split compressible resilient member which initially loosely envelopes the contact arm-carrying power lead extending into the casing of the cut-off link. After the contact arms are forced against the backing member so as to produce a desired measured contact resistance, the outer edges of the initially opened casing are crimped around the split closure member to compress the same tightly against the power lead, to fix the position of the power lead in the casing and to fix the pressure of the expanded contact-forming arm against the backing member and casing walls.

As shown in this patent, the closure member is provided with a fairly substantially wide annular well surrounding the portion thereof through which the power lead passes. This well, as well as the split in the closure member, is filled with an uncured epoxy resin to seal the end of the cut-off link involved, and the epoxy is thereafter heat cured.

However, before the present invention, substantial difficulties were encountered in rapidly and effectively filling these spaces, and so the seal was ultimately made by completely enveloping the end portion of the casing and closure with a messy appearing blob of epoxy which gave the cut-off link an undesired unfinished appearance.

The power lead from which the contact-forming arms are formed passes through an arm-deforming member. The contact-forming arms incline outwardly and pass through the open end of a transverse slot or recess defined by parallel spaces in the end face of the arm-deforming member to make contact with the casing walls. When the cut-off link is blown by an overload current, and the aforementioned pellet melts, and the contact arm-deforming member moves against the contact-forming arms to collapse the same, arcs will initially develop as these contact-forming arms separate from the casing walls. Normally, these arcs are quickly quenched as the gap between the collapsing arms increases to a given distance. However, when high energy arcs are initiated by a large current flowing under the force of a high voltage, such as under the force of 18 amperes and 300 volts, there is a danger that the high energy arcs will evaporate the material of the arm-deforming member which is continguous to the point where the contact-forming arms are being separated from the casing. This evaporated material can inhibit the quenching of the arcs, with the possible result that the contact arms can be welded to the casing so the cut-off link does not open, and/or the heat of the resulting arcs can rupture the casing walls. Another aspect of the present invention overcomes this potential problem.

SUMMARY OF THE INVENTION

In accordance with one of the features of the present invention, the split-type closure member and the epoxy sealing material described are modified. Thus, a low viscosity epoxy mix is provided which will flow more easily than the viscous epoxy material previously used. Of critical importance is the fact that the split portion of the closure member is dimensioned so that when the closure member is compressed around the power lead by the crimping of the casing walls therearound, there is left at the split portion of the closure member such a narrow slot (for example of about 0.004 inches wide and compared to about 0.012 inches previously provided) that a capillary action takes place which draws the epoxy material into the slot from the communicating well surrounding the power lead and opening onto the outer end face of the closure member. This allows the unexpectedly fast sealing of the various small spaces in the closure member with relatively small amounts of epoxy material, which reduces curing time and provides a very neat and easily reproducible appearance. Also, if there are small spaces which communicate with this slot, left between the crimped portion of the casing and the closure member, they are generally and readily filled with the epoxy material by capillary action.

In accordance with another feature of the invention, the well has a large tapered inlet section to facilitate the pouring of the epoxy into the well. This section which extends partway through the closure member and terminates at a narrow neck portion which engages the power lead when the casing is crimped around the closure member.

In accordance with a further feature of the invention, the portion of the power lead engaged by the neck portion of the closure member is roughened or knurled, to provide a greatly increased pull strength to the cut-off link. This feature could be utilized in a cut-off link which does not utilize the feature of the invention which enables fast feeding of the epoxy material by capillary action as described.

In accordance with another one of the features of the present invention, the power lead upon which the deformable contact-conforming arms are formed, is manufactured to provide a more reliable low-resistance contact interface witih the casing. The power lead is a single monolithic body made of relatively soft, low resistance material, such as copper, which is silver plated to enhance its low-resistance conducting characteristics. The resistance at the interface between the deformable arms and the associated contact surface should be minimized, thereby minimizing the creation of heat during current flow and the undesired raising of the ambient temperature within the cut-off link.

As described in the earlier-referenced patents, the power lead is formed from wire stock having axially extending slots formed therealong. One such slot is severed to form the outwardly-deformable contact arms. Severing the wire stock at each slot forms a raw edge at the end of each arm, that is, raw in the sense that the silver coating plated over the entire exterior surface of the wire stock prior to milling and severing does not extend to cover these edges. The presence of silver is desirable to form an interface with as low a resistance as possible, and it is a feature of the present invention to "wipe" the silver adjacent these raw edges over them, by a wiping force or pressure which rounds off these edges in the process of stretching the adjacent layer of the silver coating present along the outside surface of each contact arm. This process formed a tapered silver coating over the rounded ends of the contact arm. In this fashion, that portion of each contact arm which actually contacts the interior of the cut-off link casing will benefit from the presence of the highly conductive silver coating.

Yet another aspect of the present invention involves the arm-deforming member. As mentioned previously, the contact-forming arms extend into a transverse slot or recess formed in the end face of the arm-deforming member. The outer portions of this slot which open onto the casing interior are widened or beveled preferably to form wall portions inclining away from the parallel walls of the rest of the slot to increase the distance between the arms and the arm-deforming member in the vicinity of the points where the contact-forming arms engage the casing. These larger spaces near the points of contact where arcing is initiated as the arm-deforming member collapes the arms eliminates the problems which had previously prescribed rapid arc given under high short circuit current and voltage conditions.

Other features and advantages of the invention will become apparent upon making reference to the specification to follow, the claims and the drawings.

DETAILED DESCRIPTION OF THE INVENTION

Figures 1, 2, 3, 4, 5, 6, 7, 8, 9, 10:
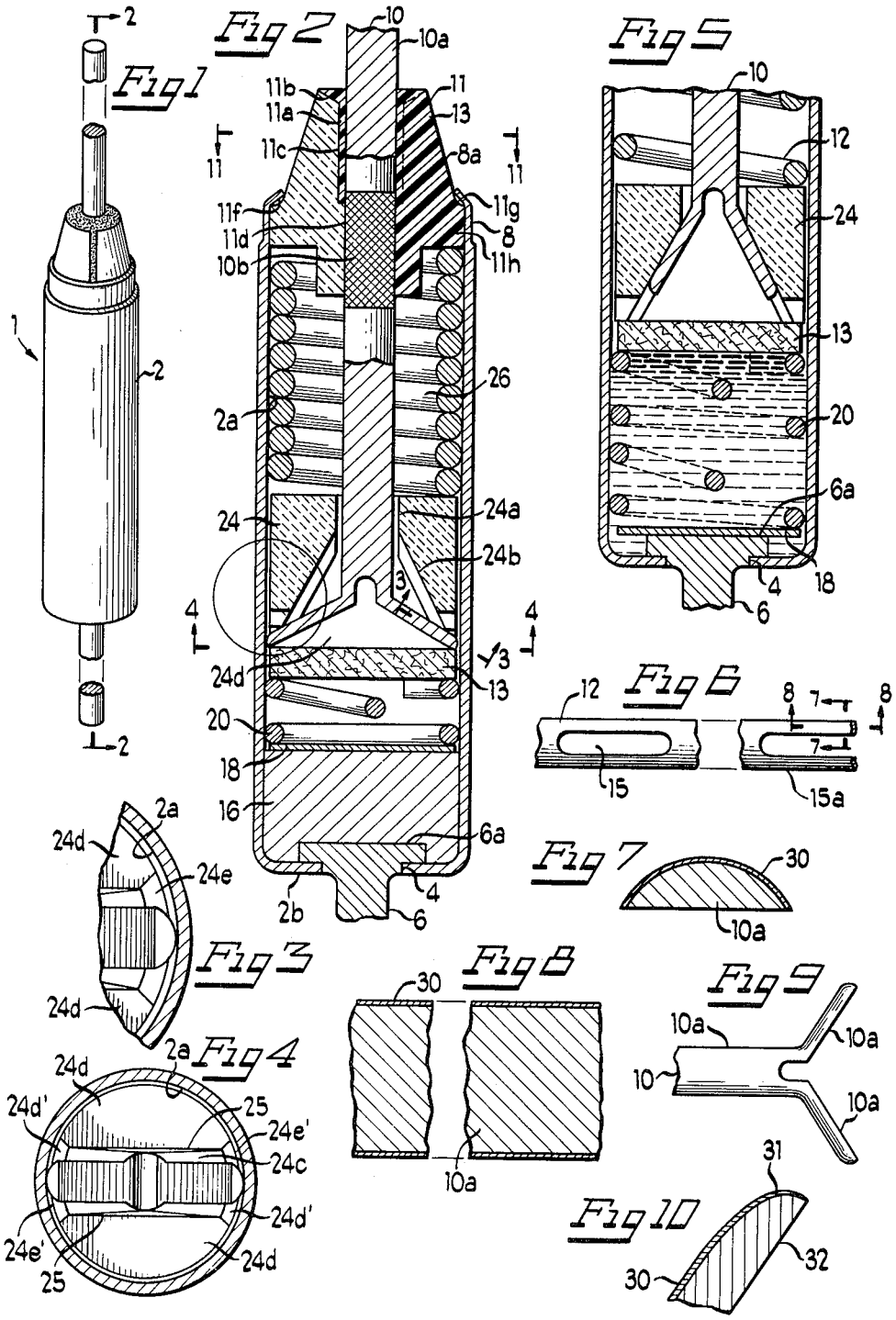
FIG. 1 is a perspective view, enlarged several times the actual size thereof, of a normallyclosed ambient thermally actuated cut-off link constructed in accordance with the present invention.
FIG. 2 is a longitudinal sectional view through the cut-off link of FIG. 1, taken along 2—2 of FIG. 1.
FIG. 3 is an enlarged fragmentary transverse section through the cut-off link shown in FIG. 2 and taken along line 3—3 thereof.
FIG. 4 is a full transverse section of the cut-off link shown in FIG. 2 taken along line 4—4 thereof.
FIG. 5 is an enlarged fragmentary sectional view of the cut-off link shown in FIG. 2, after the cut-off link has been blown.
FIG. 6 is an elevational view of a strand of wire stock from which the power leads with the integral contact-forming arms are formed.
FIG. 7 is a transverse sectional view of the power lead shown in FIG. 6 along line 7—7 thereof.
FIG. 8 is a transverse sectional view of the power lead shown in FIG. 6 along line 8—8 thereof.
FIG. 9 is a partial elevational view of the power lead of FIG. 6 with the arms deformed outwardly.
FIG. 10 is an enlarged fragmentary sectional view of the end of one of the contact arms of FIG. 9.

Referring now more particularly to FIGS. 1 through 5, the ambient thermally actuated cut-off link there shown and generally indicated by reference number 1 includes a metal casing 2, which may be made of brass and having cylindrical walls 2*a*, which are preferably silver plated on the inside and outside thereof to a thickness of about 0.0002". The casing is initially open at one end and closed by an end wall 2*b* at the other end. The end wall 2*b* has an opening 4 through which a power lead 6 passes. The power lead terminates in an enlarged head 6*a* and is swaged over the outside of the casing end wall 2*b* to form a tight, low resistance, hermetically sealed connection therewith. The power lead 6 may comprise a tin plated copper wire.

The open end of the cylindrical wall 2*a* has a reduced readily deformable skirt 8 having an end portion 8*a* which is bent around the end of a resilient compressible closure member 11 compressed tightly around a power lead 10. The power lead 10 passes through a passage or opening 11*a* in the closure member and into the initially open end of the casing 2. In the embodiment herein shown, opening or passage 11*a* has a first, inwardly tapering well inlet section 11*b*, a second, cylindrical well-forming section 11*c*, and a third smaller cylindrical section 11*d* of a diameter slightly less than the well-forming section 11*c*.

The closure member 11 is made of a resilient compressible insulating material, which maybe a high temperature resin (like TORLON grade 4203, manufactured by Amoco Chemicals Corporation).

Figure 11:
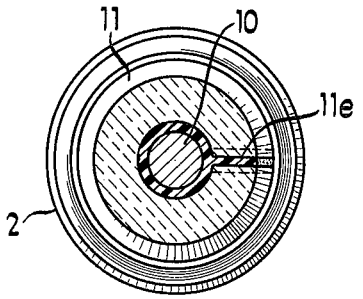
FIG. 11 is a full transverse section of the closure of the cut-off link shown in FIG. 2 and taken along line 11—11 thereof.

The closure member 11 is split at 11*e* as seen in FIG. 11 along the entire length thereof so as to form a split ring-like member where the opening 11*a* is initially larger than the diameter of a knurled portion 10*b* of the cylindrical shank portion 10*a* of the power lead 10. The split closure member 11 is forced snugly around the power lead 10 by the force of the end portion 8*a* of the casing skirt 8 swaged therearound. The outer end of the closure member 11, with annular neck portion 11*b*, defines, with the shank portion 10*a* of the power lead 10, an annular tapered well inlet.

The tapered well inlet opens onto an annular cylindrical well defined between cylindrical opening section 11*c* of the closure member and the smooth surfaced portion of the power lead 10 above the knurled portion 10*b* thereof. A curable epoxy cement fills the tapered well and the small cylindrical well as well as in the narrow slot formed by the split portion 11*e* of the closure member, as shown at 11*h* of FIG. 2. As will be explained in more detail hereinafter, the epoxy resin is drawn by capillary action into the small interstices formed by the split portion 11*e* because of the smallness of the space and the low viscosity of the epoxy resin when it is poured into the tapered inlet well before it is cured. The epoxy resin forms a hermetic seal between the power lead 10' and closure member 11. One such resin found to be satisfactory has a viscosity ranging from 10,000 to 15,000 centipoise, and is mixed in the ratio of three parts resin to one part hardener. This resin is manufactured by F. B. Fuller Company, and is identified in use as Part No. FE 1046. This epoxy resin is cured by heating. Other epoxy sealants found suitable may be cured by exposure to an ultraviolet light source.

Figure 13:
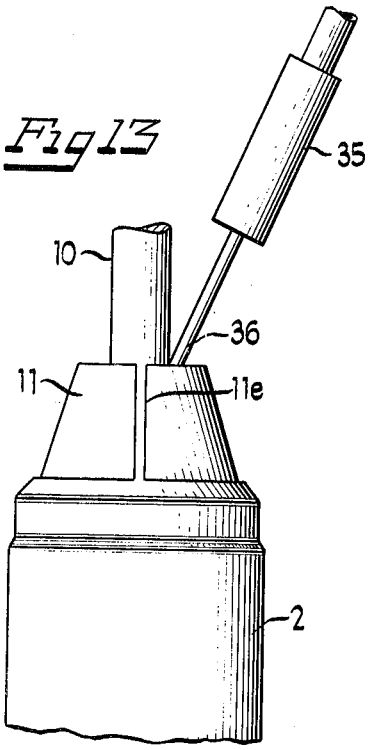
FIG. 13 is a schematic elevation showing the initial application of epoxy sealing compound.
Figure 14:
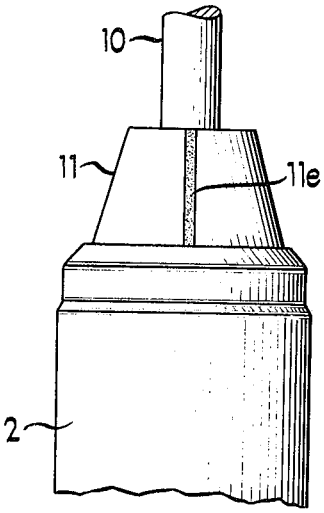
FIG. 14 is a schematic elevation showing completion of the capillary deployment of the epoxy compound.

As seen in FIGS. 13 and 14, the epoxy resin may be dispensed from an applicator 35 to the tapered inlet well. FIG. 13 shows the epoxy resin flowing into the tapered inlet well. When the epoxy resin enters this well, it is drawn by capillary action into the narrowed slot 11*e*, as shown in FIG. 14 and into similarly small communicating spaces as well.

As best seen in FIG. 2, closure 11 has shoulder 11*f* formed thereon, over which the upper portion 8*a* of casing 8 is crimped, to hold closure 11 in place. If a small channel 11*g* is left beneath portion 8*a* and extending about the circumference of casing 8 where it communicates with slot 11*e* the epoxy resin entering slot 11*e* by capillary action also enters the channel 11, to act as an additional sealant.

During the assembly procedure, when the casing skirt 8*a* is crimped around the closure member, the closure member is compressed around the knurled portion of the power lead, as previously described. Because closure member 11 is formed from a compressible, deformable material, its compression about the knurled portion 10*b* of power lead 10 serves to form a higher pull strength link due to its higher increased gripping friction between closure member 11 and the knurled portion of the power lead 10.

The power lead 10 in the proposed commercial form of the invention may be an annealed, 18 gauge copper wire 12 having a tensile strength of 30,000-35,000 lbs. per square inch and a 0.0002" coating of silver thereover. The power lead 10 may be formed from a stock of silver coated copper wire with longitudinally elongated and spaced apertures 15 extending completely through the wire stock shown in FIGS. 6, 7, and 8. The copper wire stock is then cut laterally along the apertures to form individual power leads section 15*a*, each having a longitudinal open slot at the end thereof, the portion of each lead on opposite sides of the end portion of each slot being bent outwardly to form a bifurcated end defining the contact-forming wings or arms 10*a*—10*a*. Because the severed ends 10*a*—10*a* of the wings or arms 10*a*—10*a* would have no silver thereon unless otherwise provided for, the arm ends as they are formed are rounded by a crimping and wiping action which wipes part of the adjacent silver coating 30 thereover as shown in FIG. 10. The resulting silver coating tapers, as at 31, along end 32 of arm 10*a*.

Figure 12:
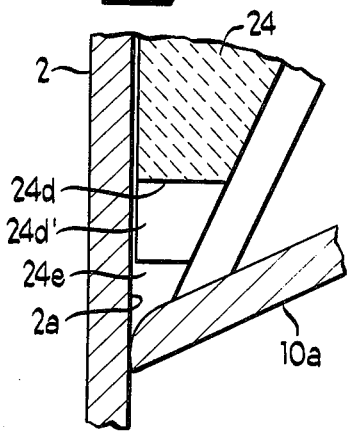
FIG. 12 is an enlarged fragmentary sectional view of the encircled portion of FIG. 2 showing the casing wall, one contact arm, and a portion of the driver.

The power lead 10 passes through a spring-biased sandwich of elements to be described and extends between the closure member 11 and the end wall 2*b* of the casing 2. The contact-forming arms 10*a*—10*a* at the then inner end of the power lead 10 are pressed by closure member 11 against a backing member 13 which expands the arms 10'*a*—10'*a* into engagement, with the silver coated inner wall surface of the cylindrical wall 2*a* of the casing 2. The copper wire used to form the power lead 10 is a soft readily deformable copper so that the arms 10*a*—10*a* when expanded into engagement with the silver coated inner walls of the casing 2 will deform somewhat to make contact over a given area greater than that provided by a point contact with the casing, as best illustrated in FIGS. 3, 4, and 12, ensuring an unusually total low contact resistance of, for example, under 1 milliohm per cut-off link.

The aforementioned sandwich of elements includes, in addition to the backing member 13 preferably made of insulating material, a pellet 16 of fusible material which will melt at a given control temperature, a metal pressure-distributing disc 18, a relatively short, strong off-centered coil spring 20, an insulating arm-deforming member 24 and a relatively weak, long coil spring 26.

The coil springs 20 and 26 may be made of music wire. The pellet 16 is located between the head 6*a* of the power lead 6 and the pressure-distributing disc 18. The pellet is preferably formed by compacting a granular mixture of fusible material against the closed end of the casing. This achieves a much more intimate engagement between the fusible material and the casing walls, to increase heat conductivity to the pellet.

The relatively short, strong, compressed coil spring 20 is shown in FIG. 2 sandwiches in a partially compressed state between the pressure-distributing disc 18 and the right side of the backing member 13. The coil spring 20 is shown as an hour-glass shaped coil spring whose wide end presses against the peripheral portions of the pressure-distributing disc 18. The arm-deforming member 24, which is preferably made of Torlon has a pair of flat-ended bosses 24*d*—24*d* bearing against the backing member 13 as viewed in FIGS. 2, 3, and 4. The arm-deforming member 24 is shown having a cylindrical passageway 24*a* through which the power lead 10 freely passes, which cylindrical passageway joins a conically-shaped arm-deforming cavity 24*b* defined between the bosses 24*d*—24*d*. The cavity 24*b* opens into a narrow slot or recess 24*c* formed by parallel walls 25—25. The slot 24*e* opens into the sides of the arm-deforming member through laterally facing openings or apertures 24*e*'—24*e*', which provide clearance openings for the arms 10*a*—10*a* extending outwardly beyond the confines of the arm-deforming member 24. The generally parallel confronting walls 25—25 of the slot 24*e* are beveled at their ends so that its defining walls of the openings or apertures 24*e*'—24*e*' angle away from the points where the contact-forming arms 10*a*—10*a* contact the inner surface of the casing 2, where arcing occurs upon the initial breaking of these contact points when the link opens. This enables the arc formed at contact opening to be quenched quickly as the arms are pushed away from the casing walls.

The relatively weak, long coil spring 26 is fully compressed between the arm-deforming member 24 by the force of the short, strong off-center, hour-glass shaped coil spring 20 which also eliminates any play in the sandwich of elements referred to. Because the coil spring 26 remains fully compressed at all times prior to the melting of the pellet 16, it is apparent that the backing member position remains fixed, and so the pressure and contact resistance between the power lead contact-forming arms 10*a*—10*a* expanded by their engagement with the backing member 13 against the casing 2 remains constant, even if the fusible pellet 16 creeps.

When the environment in which the cut-off link is placed reaches the desired control temperature, the fusible pellet 16 melts, causing the initial expansion of the stronger hour-glass shaped coil spring 20, following which the longer coil spring 26 will fully expand to force the arm-deforming member 24 to collapse the arms 10*a*—10*a* within the cavity 24*b* thereof, as shown in FIG. 5. The pressure-distributing disc 18, as well as the backing member 13 and the arm-deforming member 24, are made of a size somewhat smaller than the interior dimensions of the casing 2, so that there is clearance for the flow of the melted fusible material throughout the cut-off link, as illustrated in FIGS. 4 and 5.

It is apparent that the various improvements in the present invention made in the cut-off link which is the subject of U.S. Pat. Nos. 4,246,564 and 4,281,309 provide a much less expensive and much more reliably operated cut-off link.

It should be understood that numerous modifications may be made in the most preferred form of the invention described without deviating the broader aspects thereof, and that the embodiments presented herein are exemplary only, and not intended to limit the spirit or scope of the invention as described and claimed.

We claim:

1. In a thermally actuated cut-off link having a casing of electrically conductive material, closure means at each end of said casing, a first power lead exposed to the outside of said casing through an opening in one of said closure means formed by an insulating closure member, casing-contacting arm means at the inner end of said first power lead and making a low-resistance contact with an inner conductive surface of said casing, a second exposed power lead exposed through the other closure means and making a permanent low resistance connection with said casing, said first power lead, said casing, and said second power lead completing an electrical flow path, a sandwich of elements held under spring pressure between spaced points in said casing including stressed spring means, an arm-deforming member urged by said spring means toward said arm means when said stressed spring means is freed to move toward an unstressed state, a backing member proximate said arm-deforming member, and a fusible body which melts at a given control temperature, said casing-contacting arm means extending laterally outwardly extending and being inwardly deformable and held by said closure member in pressed relation against said backing member which expands said arm means against said casing, said arm-deforming member deforming said arm members inwardly to break contact with said interior of said casing and thereby to interrupt said flow path responsive to the melting of said fusible body, said first power lead being coated with a more highly conductive finish, the end portion of said arm means being initially devoid of said highly conductive coating, the improvement wherein:

said conductive coating is mechanically wiped over each said end portion of said arm means initially devoid of said coating so that the thickness of said coating tapers thereat.

2. The cut-off link of claim 1, wherein said end portion of said arm means having the tapered conductive coating is rounded.

3. In a thermally actuated cut-off link having a casing of electrically conductive material, closure means at each end of said casing, a first power lead exposed to the outside of said casing through an opening in one of said closure means formed by an insulating closure member, said closure member being a compressibly resilient member secured in one end of said casing, said closure member having a central passage and being split along its entire length so that it was initially loosely insertable over said power lead, the split portion of said closure member forming a radially-extending slot reaching from said passage to the exterior surface of said closure, said closure passage having a narrowed portion compressed around and in gripping relation to said power lead by a portion of said casing crimped thereover, the improvement comprising:

means for hermetically sealing said closure after said cut-off link is assembled, said sealing means including a well defined between said power lead and a portion of said central closure passage located outward of said narrowest portion of said passage, said well opening onto the outer face of said closure member to receive a hardenable low viscosity sealant material, said well communicating with said closure slot.

4. The cut-off link as recited in claim 3 wherein said closure passage portion forming said well includes a first relatively large inlet section, which forms a large annular inlet readily to receive the initially flowable sealant material; and a second, smaller cylindrical axially extending section communicating with and of smaller diameter than said first section.

5. The cut-off link as recited in claim 4 wherein said first section of said closure passage is frusto-conical in shape, and tapering axially to join said second section thereof.

6. The apparatus as recited in claim 3 wherein said slot is narrowed to no less than about 0.004 inches.

7. In a thermally actuated cut-off link having a casing of electrically conductive material, closure means at each end of said casing, a first power lead exposed to the outside of said casing through an opening in one of said closure means formed by an insulating closure member, said closure member being a compressibly resilient member secured in one end of said casing, said closure member having a central passage and being split along its entire length so that it was initially loosely insertable over said power lead, the split portion of said closure member forming a radially-extending slot reaching from said passage to the exterior surface of said closure, said closure passage having a narrowed portion compressed around and in gripping relation to said power lead by a portion of said casing crimped thereover, casing-contacting arm means at the inner end of said first power lead and making a low-resistance contact with an inner conductive surface of said casing, a second exposed power lead exposed through the other closure means and making a permanent low resistance connection with said casing, said first power lead, said casing, and said second power lead completing an electrical flow path, a sandwich of elements held under spring pressure between spaced points in said casing including stressed spring means, an arm-deforming member urged by said spring means toward said arm means when said stressed spring means is freed to move toward an unstressed state, a backing member proximate said arm-deforming member, and a fusible body which melts at a given control temperature, said casing-contacting arm means extending laterally outwardly extending and being inwardly deformable and held by said closure member in pressed relation against said backing member which expands said arm means against said casing, and said backing member said arm-deforming member deforming said arm members inwardly to break contact with said interior of said casing and thereby to interrupt said flow path responsive to the melting of said fusible body, the improvement including:

a roughened surface on said power lead opposite that portion of said closure compressed therearound and, a sealant material filling said closure slot.

8. The apparatus as recited in claim 7 wherein said roughened surface is formed by knurling the surface of said power lead.

9. In a thermally actuated cut-off link having a casing of electrically conductive material, closure means at each end of said casing, a first power lead exposed to the outside of said casing through an opening in one of said closure means through aperture means, said closure means formed by an insulating closure member, and casing-contacting arm means being at the inner end of said first power lead and making a low-resistance contact with an inner conductive surface of said casing, a second exposed power lead exposed through the other closure means and making a permanent low resistance connection with said casing, said first power lead, said casing, and said second power lead completing an electrical flow path, a sandwich of elements held under spring pressure between spaced points in said casing including stressed spring means, an arm-deforming member urged by said spring means toward said arm means when said stressed spring means is freed to move toward an unstressed state, a backing member proximate said arm-deforming member, and a fusible body which melts at a given control temperature, said first power lead passing through an axial opening in said arm-deforming member with said casing-contacting arm means on the end of said first power lead extending laterally outwardly through aperture means extending across said arm-deforming member and being inwardly deformable and held by said closure member in pressed relation against said backing member which expands said arm means in said aperture means against said casing, said arm-deforming member deforming said arm members inwardly to break contact with said interior of said casing and thereby to interrupt said flow path responsive to the melting of said fusible body and the lateral ends of said aperture means being beveled to increase air space proximate the contact of said arm means with the inner conductive surface of the casing.

* * * * *